US009146521B2

(12) United States Patent
Taguchi et al.

(10) Patent No.: US 9,146,521 B2
(45) Date of Patent: Sep. 29, 2015

(54) IMAGE FORMING APPARATUS AND IMAGE FORMING METHOD

(75) Inventors: Hiroyuki Taguchi, Shizuoka (JP); Isao Yahata, Shizuoka (JP); Takahiro Kawaguchi, Shizuoka (JP); Ken Iguchi, Shizuoka (JP); Hiroyuki Tsuchihashi, Shizuoka (JP); Hiroyuki Taki, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 613 days.

(21) Appl. No.: 13/449,256

(22) Filed: Apr. 17, 2012

(65) Prior Publication Data

US 2012/0275803 A1 Nov. 1, 2012

Related U.S. Application Data

(63) Continuation-in-part of application No. 12/779,747, filed on May 13, 2010, now abandoned.

(60) Provisional application No. 61/178,368, filed on May 14, 2009, provisional application No. 61/242,725, filed on Sep. 15, 2009.

(51) Int. Cl.

| | |
|---|---|
| ***G03G 15/20*** | (2006.01) |
| ***G03G 15/00*** | (2006.01) |
| ***G03G 21/04*** | (2006.01) |

(52) U.S. Cl.

CPC ..... *G03G 15/6585* (2013.01); *G03G 15/6582* (2013.01); *G03G 21/043* (2013.01); *G03G 2215/00021* (2013.01); *G03G 2215/00299* (2013.01)

(58) Field of Classification Search

CPC ..... G03G 2215/00299; G03G 15/6582; G03G 15/6585

USPC ..... 399/223

See application file for complete search history.

(56) References Cited

U.S. PATENT DOCUMENTS

| | | | | |
|---|---|---|---|---|
| 2008/0258454 | A1 * | 10/2008 | Bhatt et al. | 283/67 |
| 2009/0154970 | A1 * | 6/2009 | Yoshida et al. | 399/341 |
| 2010/0097421 | A1 * | 4/2010 | Yoshida et al. | 347/14 |

FOREIGN PATENT DOCUMENTS

| | | |
|---|---|---|
| JP | 06-017963 | 3/1994 |

* cited by examiner

*Primary Examiner* — David Gray
*Assistant Examiner* — Andrew V Do
(74) *Attorney, Agent, or Firm* — Patterson & Sheridan, LLP

(57) ABSTRACT

An image forming apparatus forms a stamp image with a stamp image developer having a color developing temperature at a color erasing temperature of an image forming developer, and forms a mask image with a mask image developer having a color re-developing temperature at a temperature not lower than a color re-developing temperature of the image forming developer. Accordingly, when a confidential document is color-erased, the stamp image develops color, and when the color-erased confidential document again develops color, it can not be read.

11 Claims, 9 Drawing Sheets

IMAGE FORMING APPARATUS AND IMAGE FORMING METHOD

CROSS-REFERENCE TO RELATED APPLICATIONS

This application is a continuation-in-part of U.S. patent application Ser. No. 12/779,747 filed May 13, 2010, which is based upon and claims the benefit of priority from Provisional U.S. Applications 61/178,368 filed on May 14, 2009 and 61/242,725 filed on Sep. 15, 2009. The entire contents of the foregoing applications are incorporated herein by reference.

TECHNICAL FIELD

The present invention relates to an image forming apparatus capable of keeping security of a recording medium on which an image is formed with color erasable developer, and an image forming method.

BACKGROUND

In recent years, from the demand for resource saving, an image forming apparatus in which an image is formed with color erasable developer and a color erasing apparatus are introduced. In this color erasing apparatus, heat or light is applied to a recording medium, on which an image is formed with color erasable developer, to erase the color of the developer, and erases the image. Accordingly, the recording medium after the color erase can be re-used.

Here, there arises a problem in handling when an image of a confidential document is formed by the above image forming apparatus. This is because when the color erasable developer is cooled to a very low temperature, color development can again occur. Besides, this is because there is a risk that a readable state occurs even if color development does not again occur.

In this point, an image forming apparatus is proposed in which an image of identification information indicating confidential document is formed on a confidential document, and when the recording medium is reused, when the image forming apparatus detects this identification information, it is used for control of copying.

DETAILED DESCRIPTION

Throughout this description, the embodiments and examples shown should be considered as exemplars, rather than limitations on the apparatus and methods of the present invention.

Hereinafter, an image forming apparatus and an image forming method of an embodiment of the invention will be described in detail with reference to the drawings. Here, the image forming apparatus includes a copying machine, an MFP (Multifunction Peripheral) and a printer.

The image forming apparatus according to the embodiment includes, a first supply unit configured to supply a first image forming material with a color when an image is formed, and the color of the first image forming material is erased by being heated at a first temperature; a second supply unit configured to supply a second image forming material without a color when an image is formed, and the second image forming material develops the color by being heated at a second temperature lower than the first temperature; and an image forming unit configured to form a first image by the first image forming material supplied from the first supply unit and a second image by the second image forming material supplied from the second supply unit on a sheet.

Figure 1A:
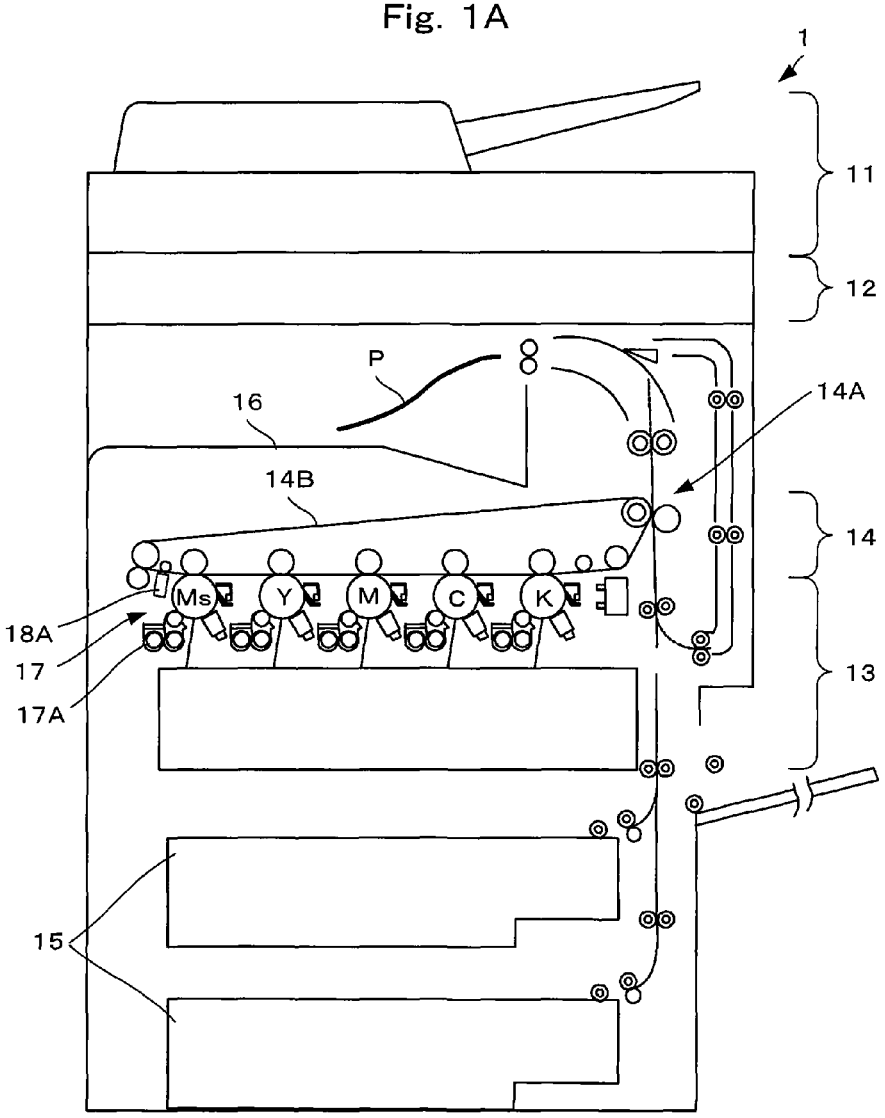
FIG. 1A is a diagram showing a structure of an image forming apparatus of an electrophotographic-type which is capable of forming a color image.

FIG. 1A is a diagram showing a structure of an image forming apparatus 1 of an electrophotographic-type capable of forming a color image according to this embodiment. As shown in FIG. 1A, the image forming apparatus 1 includes an auto document feeder 11, an image reading portion 12, an image forming portion 13, a transfer portion 14, a sheet conveyance device and a paper feed unit 15.

The auto document feeder 11 is openably and closably provided at an upper part of a main body of the image forming apparatus 1. The auto document feeder 11 includes a document conveyance device to take out documents one by one from a paper feed tray and convey them to a storage tray.

The auto document feeder 11 conveys documents one by one to a document reading portion of the image reading portion 12 by a document conveyance device. Besides, the auto document feeder 11 is opened and a document can be placed on a document table of the image reading portion 12.

The image reading portion 12 includes a carriage provided with an exposure lamp to expose a document and a first reflecting mirror, plural second reflecting mirrors provided on a main body frame of the image forming apparatus 1, a lens block, and a CCD (Charge Coupled Device) of an image reading sensor.

The carriage rests in the document reading portion or reciprocates under the document table, and causes the first reflecting mirror to reflect the light of the exposure lamp reflected by the document. The plural second reflecting mirrors reflect the reflected light of the first reflecting mirror to the lens block. The lens block varies the reflected light and outputs it to the CCD. The CCD converts the incident light into an electric signal, and outputs it as an image signal to the image forming portion 13.

The image forming portion 13 may be the electrophotographic-type, or an ink jet-type.

When the image forming portion 13 is the electrophotographic-type, the image forming portion 13 includes a laser irradiation unit, a photoconductive drum as an electrostatic latent image carrier and a developer supply unit for supplying a developer as the image forming material for each of yellow Y, magenta M, cyan C, black K and after-mentioned mask image Ms.

A mask image developer supply unit 17A supplies a mask image developer to an electrostatic latent image of a mask image on a mask image photoconductive drum Ms. The mask image developer supply unit 17A and the mask image photoconductive drum Ms are called a mask image forming portion 17.

Besides, the image forming portion 13 includes a stamp device 18A as a stamp image developer supply unit. The stamp device 18A uses a developer to form a previously determined image, for example, "confidential document" on a transfer belt 14B.

The laser irradiation unit irradiates a laser beam to the photoconductive drum based on the image signal and forms the electrostatic latent image on the photoconductive drum. The developer supply unit supplies the developer to the photoconductive drum, and forms a developer image from the electrostatic latent image.

The paper feed unit 15 takes out recording media one by one from a paper feed cassette and delivers them to the sheet conveyance device. The sheet conveyance device conveys the recording medium to the transfer portion 14.

The transfer portion 14 includes a transfer belt 14B, a transfer roller and a fixing device 14A. The transfer belt 14B as the image carrier receives the developer image of the photoconductive drum and carries it. The transfer roller applies a voltage and transfers the developer image of the transfer belt to the conveyed recording medium. The fixing device 14A heats and pressurizes the developer image and fixes it to the recording medium.

Figure 1B:
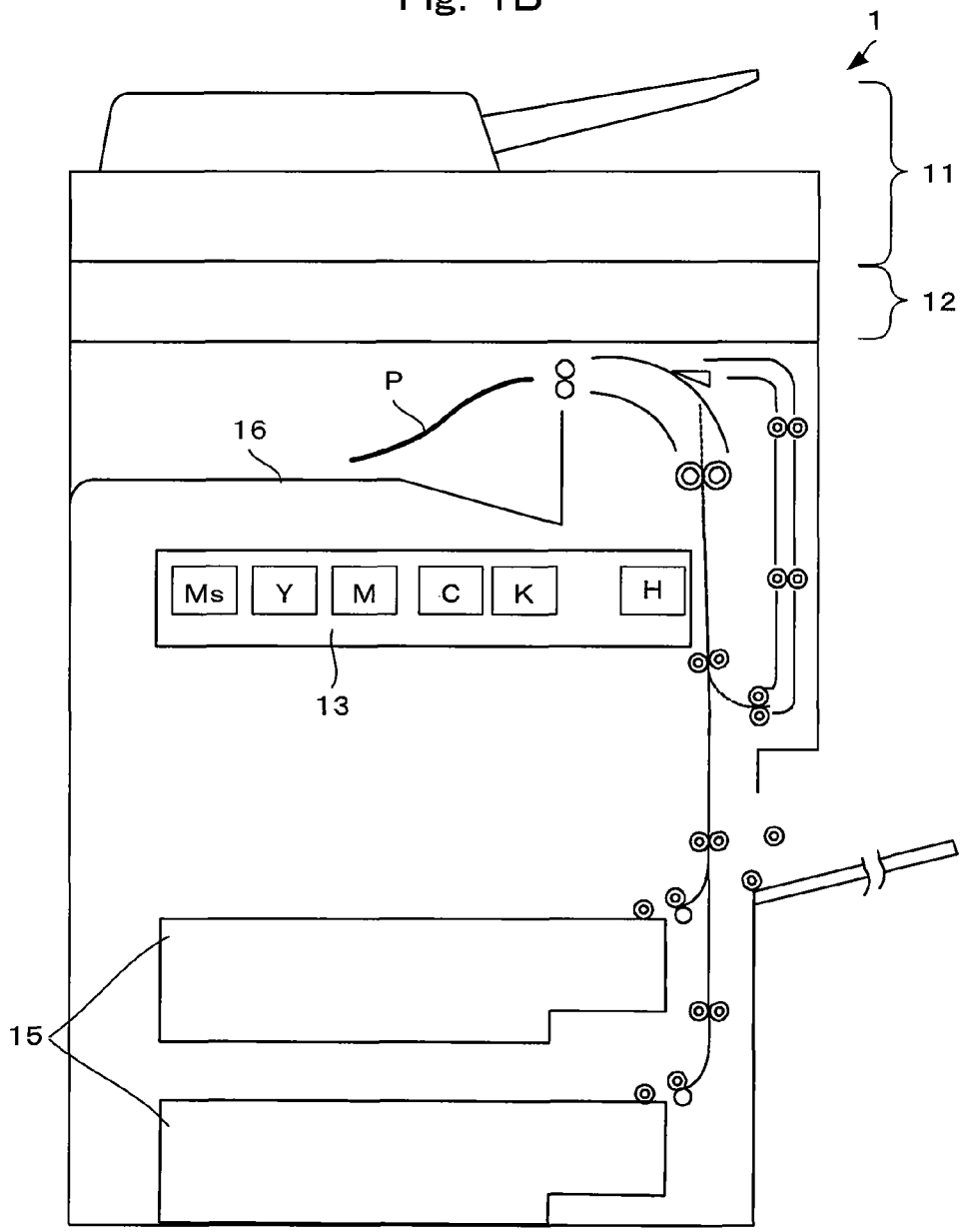
FIG. 1B is a diagram showing a structure of the image forming apparatus of an ink jet-type which is capable of forming a color image.

FIG. 1B is a diagram which shows a structure of the ink jet-type image forming apparatus 1 capable of forming a color image according to the embodiment. As shown in FIG. 1B, when the image forming portion 13 is the ink jet-type, the image forming portion 13 includes an ink supply unit for supplying ink as the image forming material for each of yellow Y, magenta M, cyan C, black K and after-mentioned mask image Ms.

The image forming portion 13 includes a head H for ejecting ink which is supplied from the ink supply unit on a sheet.

The head H includes, a substrate; a piezoelectric element which is pasted in two layers on the substrate so that the polarities thereof are different from each other; an electrode which is provided in a pressure chamber which is formed by cutting the piezoelectric element; a nozzle plate which has an ink discharge hole, and covers the pressure chamber; and a driving element which applies a voltage to the electrode.

When a voltage is applied to the electrode, the piezoelectric element is elastically deformed. Further, when a voltage with a different phase is applied to the electrode, the piezoelectric element is elastically deformed to the opposite side. By repeatedly applying the voltage, the supply of ink to the pressure chamber and the ejection of ink from the pressure chamber are repeated.

The recording medium P discharged from a paper discharge port is stacked on the storage tray 16 as a supporting portion for supporting recording media.

Figure 2:
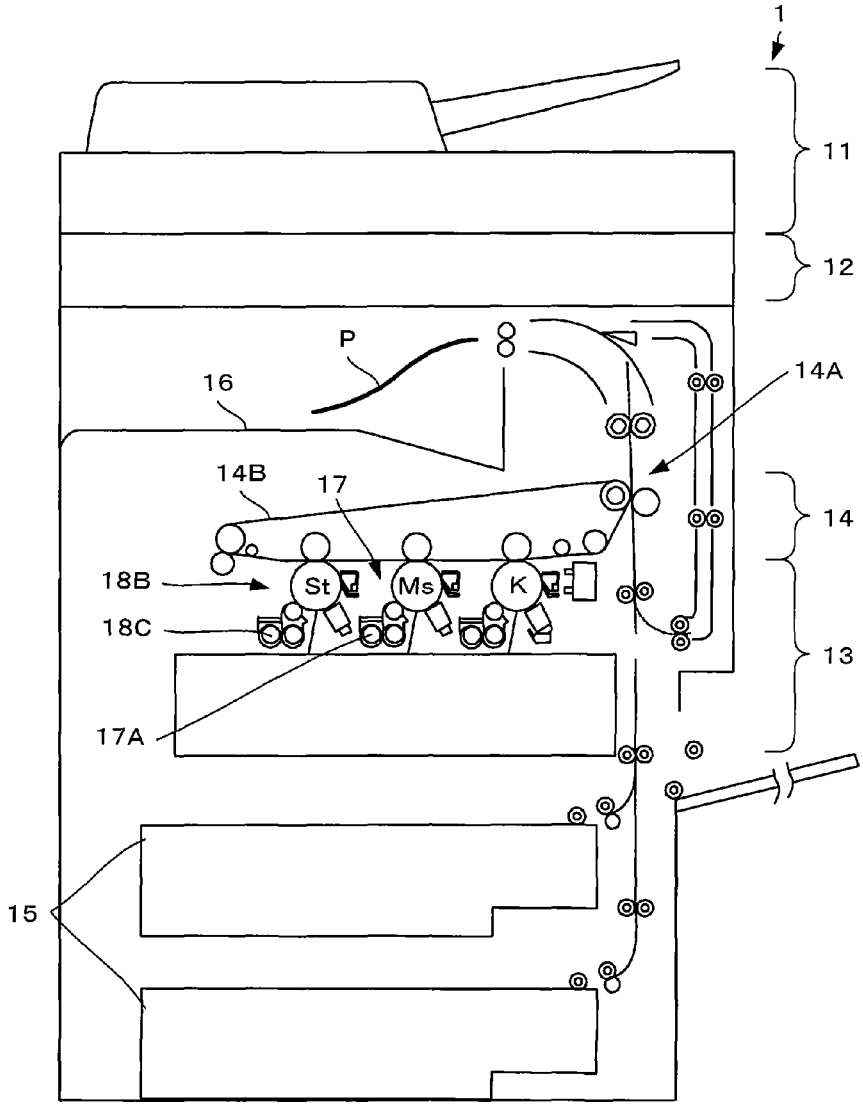
FIG. 2 is a diagram showing a structure of an image forming apparatus capable of forming a monochrome image.

FIG. 2 is a diagram showing a structure of an image forming apparatus 1 capable of forming a monochrome image according to this embodiment. As shown in FIG. 2, the image forming apparatus 1 includes an auto document feeder 11, an image reading portion 12, an image forming portion 13, a transfer portion 14, a sheet conveyance device and a paper feed unit 15.

The auto document feeder 11 is openably and closably provided at an upper part of a main body of the image forming apparatus 1. The auto document feeder 11 includes a document conveyance device to take out documents one by one from a paper feed tray and convey them to a storage tray.

The auto document feeder 11 conveys the documents one by one to a document reading portion of the image reading portion 12 by a document conveyance device. Besides, the auto document feeder 11 is opened and a document can be placed on a document table of the image reading portion 12.

The image reading portion 12 includes a carriage provided with an exposure lamp to expose a document and a first reflecting mirror, plural second reflecting mirrors provided on a main body frame of the image forming apparatus 1, a lens block, and a CCD (Charge Coupled Device) of an image reading sensor.

The carriage rests in the document reading portion or reciprocates under the document table, and causes the first reflecting mirror to reflect the light of the exposure lamp reflected by the document. The plural second reflecting mirrors reflect the reflected light of the first reflecting mirror to the lens block. The lens block varies the reflected light and outputs it to the CCD. The CCD converts the incident light into an electric signal, and outputs it as an image signal to the image forming portion 13.

The image forming portion 13 includes a laser irradiation unit, a photoconductive drum as an electrostatic latent image carrier and a developer supply unit for each of black K, an after-mentioned mask image Ms and an after-mentioned stamp image St.

A mask image developer supply unit 17A supplies a mask image developer to an electrostatic latent image on a mask image photoconductive drum Ms. The mask image developer supply unit 17A and the mask image photoconductive drum Ms are called a mask image forming portion 17.

A stamp image developer supply unit 18C supplies a stamp image developer to an electrostatic latent image on a stamp image photoconductive drum St. The stamp image developer supply unit 18C and the stamp image photoconductive drum St are called a stamp image forming portion 18.

The laser irradiation unit irradiates a laser beam to the photoconductive drum based on the image signal and forms the electrostatic latent image on the photoconductive drum. The developer supply unit supplies the developer to the photoconductive drum, and forms a developer image from the electrostatic latent image.

The paper feed unit 15 takes out recording media one by one from a paper feed cassette and delivers them to the sheet conveyance device. The sheet conveyance device conveys the recording medium to the transfer portion 14.

The transfer portion 14 includes a transfer belt 14B, a transfer roller and a fixing device 14A. The transfer belt 14B as the image carrier receives the developer image of the photoconductive drum and carries it. The transfer roller applies a voltage and transfers the developer image of the transfer belt to the conveyed recording medium. The fixing device 14A heats and pressurizes the developer image and fixes it to the recording medium.

The recording medium P discharged from a paper discharge port is stacked on the storage tray 16 as a supporting portion for supporting recording media.

Figure 3:
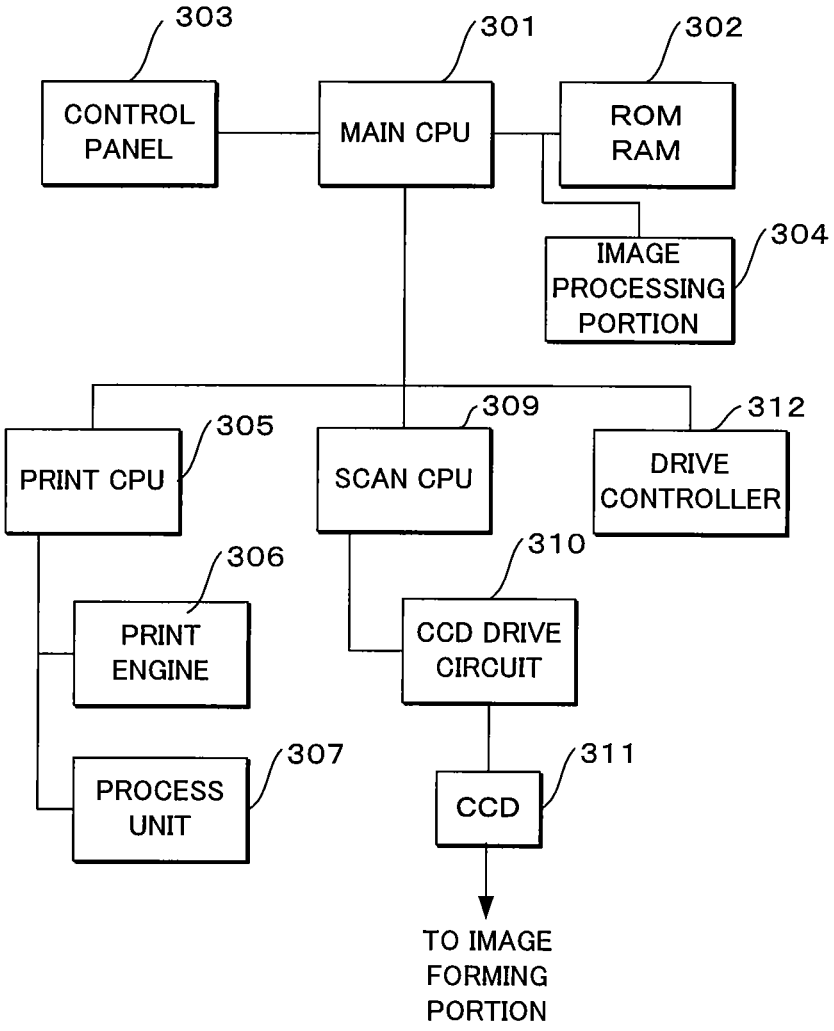
FIG. 3 is a schematic diagram showing a structure of an image forming apparatus.

FIG. 3 is a schematic diagram showing a structure of the image forming apparatus 1. As shown in FIG. 3, the image forming apparatus 1 includes a main CPU 301 as a controller to overall control the entire image forming apparatus 1, a control panel 303 connected to the main CPU 301, a ROM, RAM 302 as a storage device, and an image processing portion 304 to perform image processing.

The main CPU 301 is connected to a print CPU 305 to control respective parts of an image forming system, a scan CPU 309 to control respective parts of an image reading system, and a drive controller 312 to control a drive portion.

The print CPU 305 controls a print engine to form an electrostatic latent image on a photoconductive drum, and a process unit 307 to form a developer image.

The scan CPU 309 controls a CCD drive circuit 310 to drive a CCD 311. A signal from the CCD 311 is outputted to the image forming portion 13.

Figure 4:
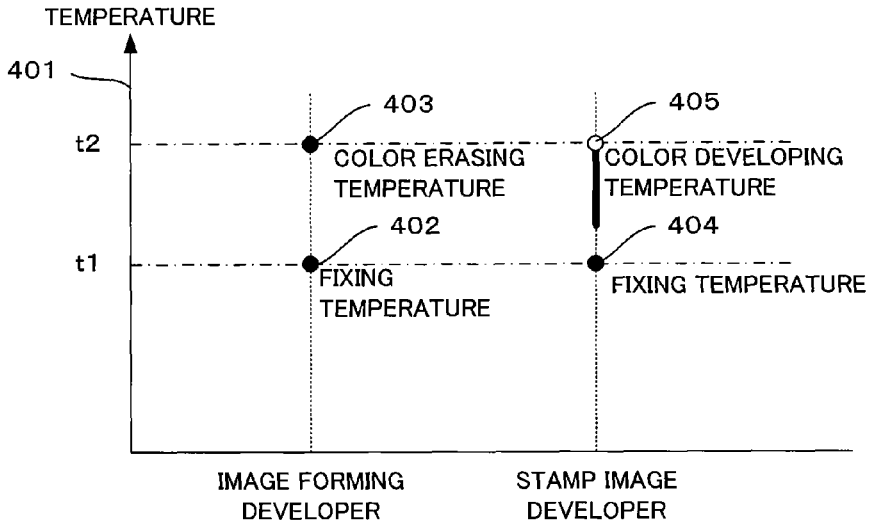
FIG. 4 is a diagram showing a relation of an image forming developer and a stamp image developer to temperature.

FIG. 4 is a diagram showing a relation of an image forming developer and a stamp image developer to temperature. A vertical axis 401 indicates the temperature. As shown in FIG. 4, it is assumed that with respect to the image forming developer of yellow Y, magenta M, cyan C and black K, a fixing temperature 402 to a recording medium is a temperature t1, and a color erasing temperature 403 at which the color of the developer is erased is a temperature t2 higher than the temperature t1.

The image forming developer is with a color at the time of image formation.

The stamp image developer is without a color at the time of stamp image formation. With respect to the stamp image developer, a fixing temperature 404 is t1 equal to the fixing temperature 402 of the image forming developer. With respect to the stamp image developer, a color developing temperature 405 at which color is developed is a temperature higher than this fixing temperature 404 and lower than the color erasing temperature 403 of the image forming developer. The stamp image developer develops color at a temperature not lower than the color developing temperature 405.

Figure 5:
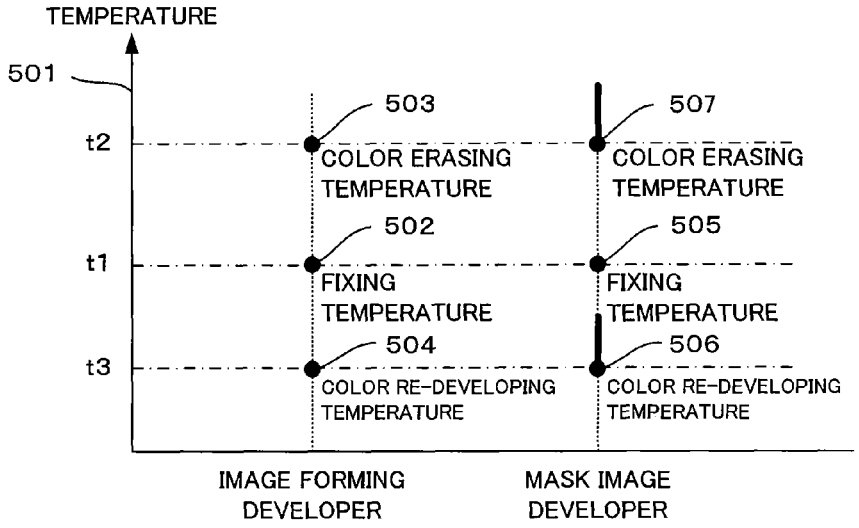
FIG. 5 is a diagram showing a relation of an image forming developer and a mask image developer to temperature.

FIG. 5 is a diagram showing a relation of the image forming developer and the mask image developer to temperature. A vertical axis 501 indicates the temperature. As shown in FIG. 5, with respect to the image forming developer of yellow Y, magenta M, cyan C and black K, it is assumed that a fixing temperature 502 to a recording medium is a temperature t1, a color erasing temperature 503 at which the color of the developer is erased is a temperature t2 higher than the temperature t1, and a color re-developing temperature 504 as a temperature at which the developer, the color of which was once erased, again develops color is a temperature t3 lower than the fixing temperature 502.

The mask image developer does not develop color at the time of image formation of a mask image. With respect to the mask image developer, a fixing temperature 505 is t1 equal to the fixing temperature 502 of the image forming developer. With respect to the mask developer, a color re-developing temperature 506 is lower than the fixing temperature 505 and not lower than the color re-developing temperature 504 of the image forming developer. That is, the color of the mask image developer is re-developed earlier than the image forming developer, or simultaneously with the image forming developer when the color is re-developed due to the low temperature. The color of the mask image developer is erased when the temperature of a color erasing temperature 507 is the same as that of the color erasing temperature 503, or higher. When being heated at the temperature of the color erasing temperature 507 or higher, the mask image developer enters a non-colored state. When the mask image developer enters the non-colored state due to the high temperature, the color of the mask image developer is erased later than the image forming developer, or at the same time as the image forming developer.

Figure 6:
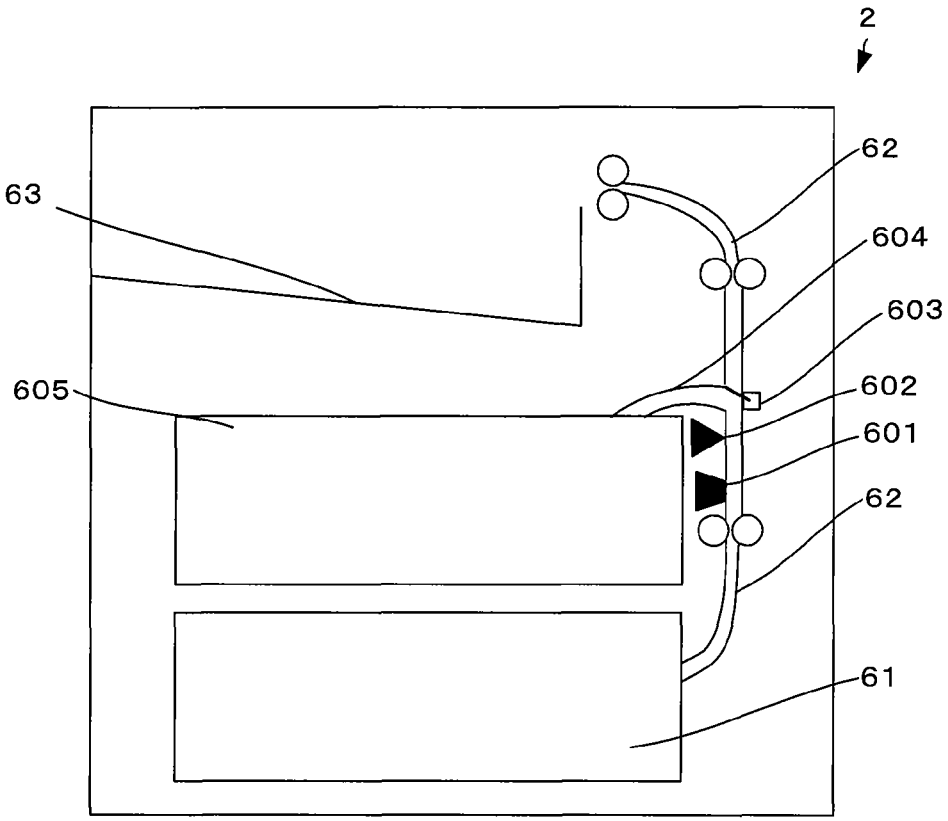
FIG. 6 is a diagram showing a structure of a color erasing apparatus.

FIG. 6 is a diagram showing a structure of a color erasing apparatus 2. As shown in FIG. 6, the color erasing apparatus 2 includes a recording medium storage portion 61 to store a recording medium on which an image is formed with color erasable developer, a recording medium conveyance device 62 to take out and convey recording media one by one from the recording medium storage portion 61, a storage tray 63 on which a color-erased recording medium is stacked, a collection box 605 to store an un-reusable recording medium, and a recording medium conveyance path 604 to the collection box.

Besides, the color erasing apparatus 2 includes a thermal head 601 as a heating device disposed at a middle of the recording medium conveyance device 62, a scanner 602 as an image reading device disposed downstream of the thermal head 601 in a recording medium conveyance direction, and a switching device 603 which is disposed downstream of the scanner 602 in the recording medium conveyance direction and selectively switches the direction of a conveyance path of the recording medium between a direction toward the storage tray 63 and a direction toward the collection box 605.

Figure 7:
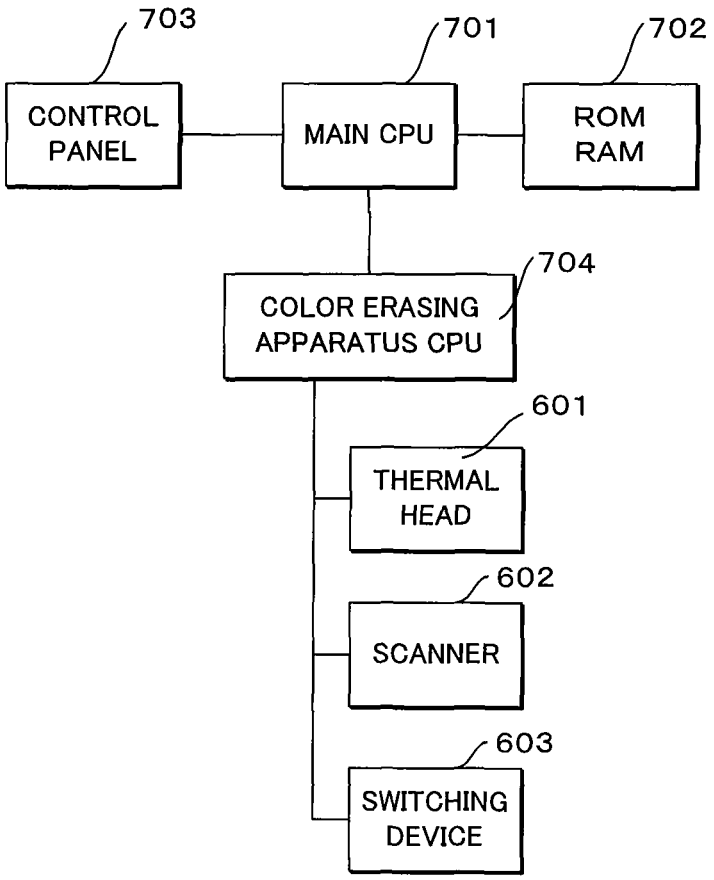
FIG. 7 is a schematic diagram showing a structure of the color erasing apparatus.

FIG. 7 is a schematic diagram showing a structure of the color erasing apparatus 2. As shown in FIG. 7, the color erasing apparatus 2 includes a main CPU 701 as a controller to overall control the entire color erasing apparatus 2, a control panel 703 connected to the main CPU 701, and a ROM, RAM 702 as a storage device.

The main CPU 701 is connected to a color erasing apparatus CPU 704 to control the thermal head 601. The color erasing apparatus CPU 704 is connected to the scanner 602, the thermal head 601 and the switching device 603 which are installed in the color erasing apparatus 2.

Figure 8:
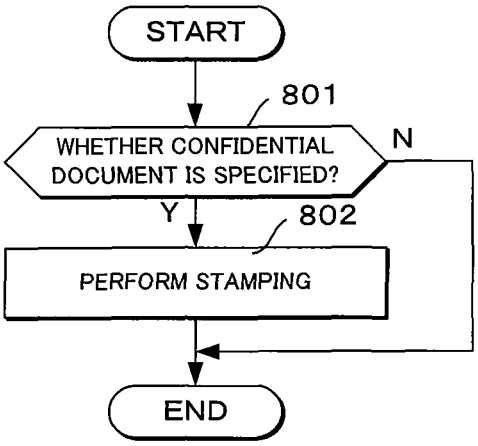
FIG. 8 is a flowchart showing a stamp image forming operation in the image forming apparatus.

FIG. 8 is a flowchart showing a stamp image forming operation of the image forming apparatus 1. As shown in FIG. 8, at Act 801, the image forming apparatus 1 determines whether a designation indicating confidential document is inputted from the control panel. When the designation indicating confidential document is inputted from the control panel, the image forming apparatus 1 advances to Act 802, and when not inputted, the procedure is ended.

At Act 802, the image forming apparatus 1 forms a stamp image.

Here, a mask image will be described. The mask image is a solidly shaded print or a pattern in which a character can not be read when it overlaps the character. The mask image is formed only in the range of the confidential document or on the whole surface of the recording medium. The range of the confidential document can be designated through the control panel 303. The mask image may be formed on all recording media, or may be formed only when the designation indicating confidential document is inputted from the control panel.

When the mask image is formed on the whole surface, the stamp image is formed in a range not overlapping the mask image.

Figure 9:
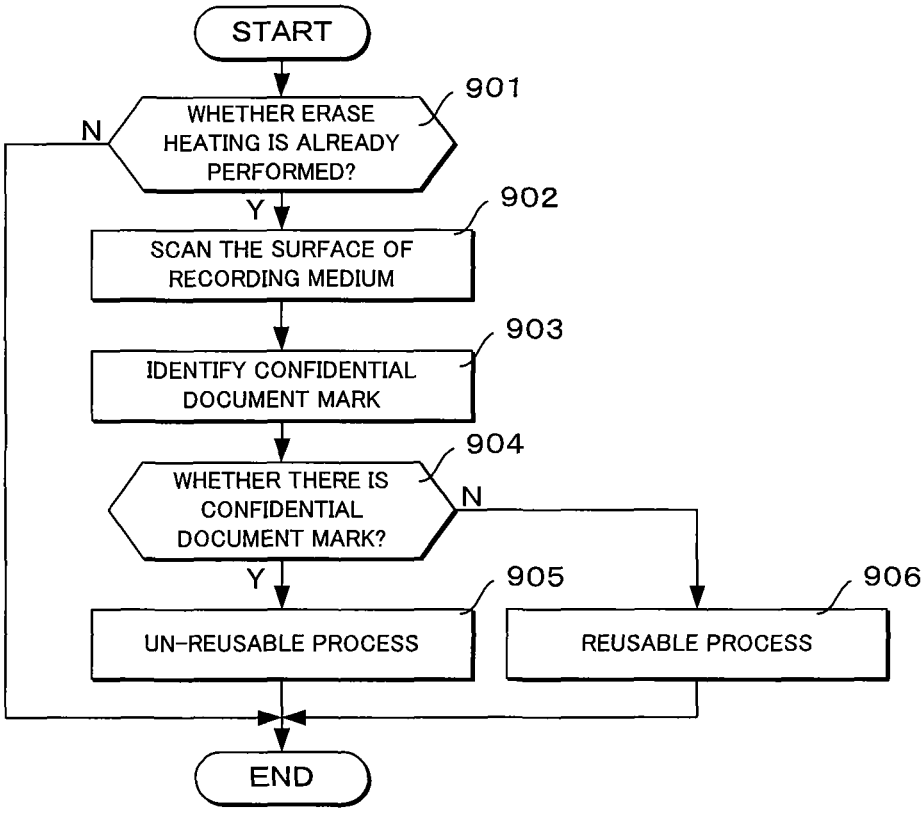
FIG. 9 is a flowchart showing an operation of the color erasing apparatus.

FIG. 9 is a flowchart showing an operation of the color erasing apparatus 2. As shown in FIG. 9, at Act 901, it is determined whether the color erasing apparatus 2 performs color erase heating, which is heating for color erasing, to the recording medium. When the color erasing apparatus 2 performs the color erase heating, advance is made to Act 902, and when not, the procedure is ended.

Here, although the stamp image developer does not develop color at the time of fixing to the recording medium, it develops color when heated at a temperature lower than the color erasing temperature 403 of the image forming developer. That is, when heating is performed by the color erasing apparatus 2 for color erasing, the stamp image develops color and can be visually recognized.

At Act 902, the color erasing apparatus 2 scans the surface of the recording medium by the scanner 602.

At Act 903, the color erasing apparatus 2 identifies the image read by the scanner 602.

At Act 904, the color erasing apparatus 2 determines whether a confidential document mark as the stamp image exists in the identified image. When the confidential document mark exists in the identified image, the color erasing apparatus 2 advances to Act 905, and when not, advance is made to Act 906.

At Act 905, the color erasing apparatus 2 performs an un-reusable process. For example, the color erasing apparatus 2 switches the switching device 603 to the direction toward the collection box 605, and collects the recording medium having the confidential document mark into the collection box 605.

Figure 10:
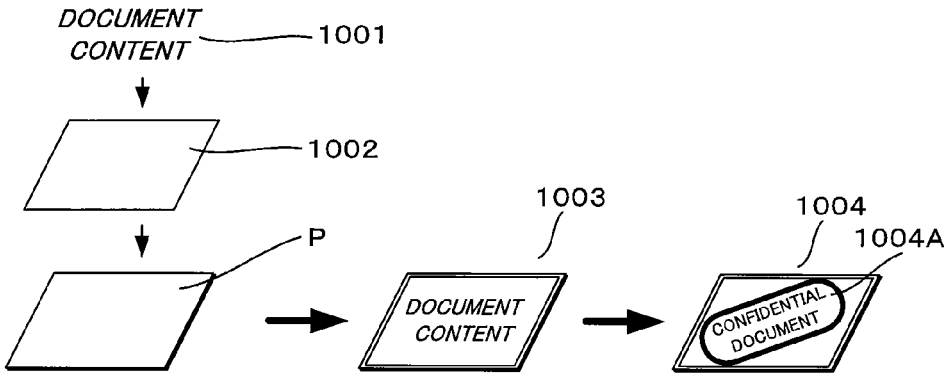
FIG. 10 is a diagram showing a state of image formation of a stamp image and a state of color development.

FIG. 10 is a diagram showing a state of image formation of a stamp image and a state of color development. As shown in FIG. 10, a stamp image 1002 is first formed on a recording medium P with a stamp image developer in a state where color development does not occur, and further, an image of a document content 1001 is formed with an image forming developer.

When a recording medium 1003 on which the image was formed is color-erased by the color erasing apparatus 2, as in a state 1004 after the color erasing, a "confidential document" stamp 1004A as the stamp image develops color. Accordingly, the stamp image can be visually recognized, and can be scanned by the scanner 602.

Figure 11:
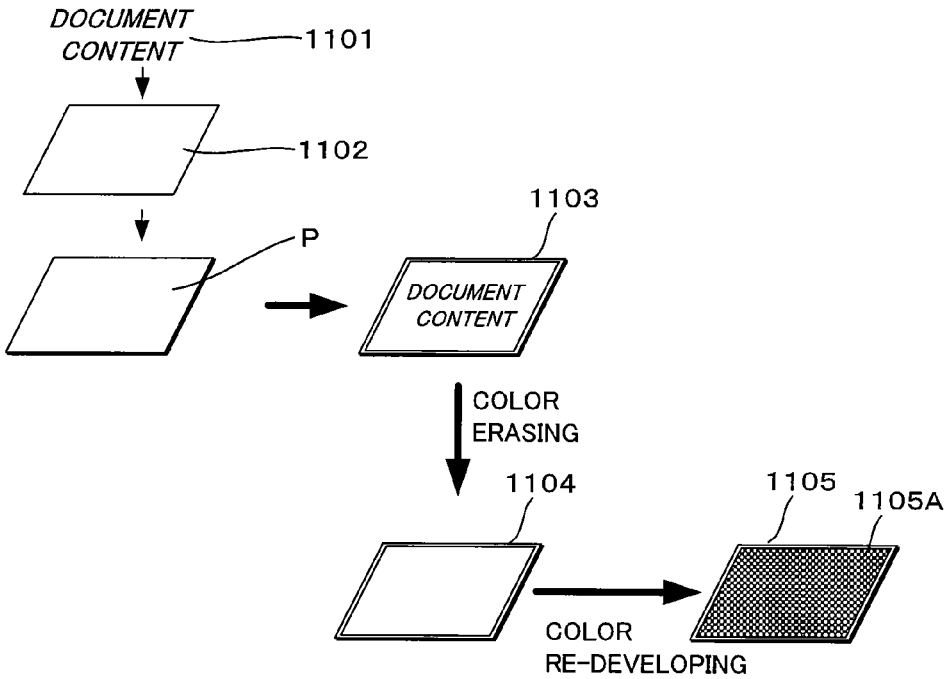
FIG. 11 is a diagram showing a state of image formation of a mask image and a state of color development.

FIG. 11 is a diagram showing a state of image formation of a mask image and a state of color development. As shown in FIG. 11, a mask image 1102 is formed on a recording medium P with a mask image developer in a state where color development does not occur, and further, an image of a document content 1101 is formed with an image forming developer.

When the recording medium P on which the image was formed is heated and is color-erased, the document content is color-erased (1104). In this state, when the recording medium is cooled to a color re-developing temperature (1105), although the document content again develops color, a mask image 1105A also develops color. Accordingly, the document content can not be read.

As described above, in the image forming apparatus 1, the color erasing apparatus 2 and the security keeping method according to the embodiment, the image forming apparatus 1 forms the stamp image with the stamp image developer having the color developing temperature 405 at the color erasing temperature 403 of the image forming developer, and forms the mask image with the mask image developer having the color re-developing temperature 506 at a temperature not lower than the color re-developing temperature 504 of the image forming developer.

Accordingly, when the confidential document is color-erased, the stamp image develops color, and when the color-erased confidential document again develops color, it cannot be read, and there is an effect that the security can be efficiently kept.

While certain embodiments have been described, these embodiments have been presented by way of example only, and are not intended to limit the scope of the inventions. Indeed, the novel methods and apparatuses described herein maybe embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. An image forming apparatus, comprising:

a first supply unit configured to supply a first image forming material for forming an image on a sheet with a color, the color of first image forming material being erased by being heated at a first temperature, and the color of first image forming material being re-developed by being heated at a second temperature lower than the first temperature after the color is erased at the first temperature;

a second supply unit configured to supply a second image forming material for forming an image on a sheet without a color, the color of the second image forming material being developed at a third temperature which is higher than the second temperature; and an image forming unit configured to form a first image by the first image forming material supplied from the first supply unit and a second image by the second image forming material supplied from the second supply unit, on a sheet.

2. The apparatus according to claim 1, wherein the image forming unit forms the second image overlapped with the first image on the sheet.

3. The apparatus according to claim 2, wherein the color of the second image forming material which is developed at the third temperature is erased at a fourth temperature which is higher than the first temperature.

4. The apparatus according to claim 3, further comprising:

a fixing unit configured to fix, on the sheet, the first image formed using the first image forming material with a color and the second image formed using the second image forming material without a color by heating the sheet at a fixing temperature which is higher than the third temperature and is lower than the first temperature.

5. The apparatus according to claim 1, wherein the second image is overlapped with the first image on the sheet so that the first image is not distinguishable from the second image if the color of the second image is developed at the third temperature.

6. The apparatus according to claim 1, the image forming unit forms at least one of the first image and the second image by ink-jet.

7. An image forming method, comprising:

forming a first image with a color on a sheet using a first image forming material, the color of the first image forming material being erased by being heated at a first temperature, the color of the first image forming material being re-developed by being heated at a second temperature which is lower than the first temperature after the color of the first image forming material is erased by being heated at the first temperature;

forming a second image without a color on the sheet using a second image forming material, the color of the second image forming material being developed by being heated at a third temperature which is higher than the second temperature.

8. The method according to claim 7, further comprising:

forming the second image by overlapping the first image on the sheet.

9. The method according to claim 7, wherein the color of the second image forming material which is developed at the third temperature is erased at a fourth temperature which is higher than the first temperature.

10. The method according to claim 9, further comprising:

fixing the first image with a color formed using the first image forming material and the second image without a color formed using the second image forming material on the sheet by heating the images at a fixing temperature which is higher than the third temperature and is lower than the first temperature.

11. The method according to claim 7, further comprising:

forming the second image by overlapping the first image on the sheet so that the first image is not distinguishable from the second image when the color of the second image is developed at the third temperature.

* * * * *